US007474868B2

(12) United States Patent
Nakano

(10) Patent No.: US 7,474,868 B2
(45) Date of Patent: Jan. 6, 2009

(54) BELT UNIT AND IMAGE-FORMING DEVICE HAVING THE SAME

(75) Inventor: Hiroshi Nakano, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 378 days.

(21) Appl. No.: 11/376,102

(22) Filed: Mar. 16, 2006

(65) Prior Publication Data

US 2006/0220302 A1 Oct. 5, 2006

(30) Foreign Application Priority Data

Mar. 18, 2005 (JP) ..... 2005-080240

(51) Int. Cl.
*G03G 15/00* (2006.01)
*G03G 21/00* (2006.01)

(52) U.S. Cl. ..... 399/303; 399/167; 399/313

(58) Field of Classification Search ..... 399/162, 399/167, 303, 313, 301, 394, 396, 302, 308; 198/804

See application file for complete search history.

(56) References Cited

U.S. PATENT DOCUMENTS 6,023,596 A * 2/2000 Makino ..... 399/167
6,420,807 B1 * 7/2002 Tsujimoto et al. ..... 399/167 X
6,597,473 B1 * 7/2003 Rasmussen et al. ..... 358/1.9
6,600,893 B2 7/2003 Ashibe et al.
6,737,133 B2 5/2004 Kusaba et al.
6,941,096 B2 9/2005 Matsuda et al.
2002/0058189 A1 5/2002 Tanaka et al.
2004/0184845 A1 * 9/2004 Mitamura et al. ..... 399/303
2005/0249524 A1 * 11/2005 Matsuda et al. ..... 399/167
2006/0184258 A1 * 8/2006 Matsuda et al. ..... 399/167 X
2007/0019998 A1 * 1/2007 Inui et al. ..... 399/302

FOREIGN PATENT DOCUMENTS

JP 5-027539 2/1993
JP 2002-365866 12/2002
JP 2003-173067 6/2003
JP 2004-123383 4/2004

* cited by examiner

*Primary Examiner*—Sophia S Chen
(74) *Attorney, Agent, or Firm*—Banner & Witcoff, Ltd

(57) ABSTRACT

A belt unit includes a drive roller, a follower roller and an endless belt looped around the drive roller and follower roller, and formed of a resilient material. The drive roller transfers a first force based on the driving force to the endless belt to circularly move at a first velocity at a first boundary between the drive roller and the endless conveying belt. The first velocity provides a first fluctuation. The endless belt transfers a second force based on the first force to the follower roller to rotate. The endless belt moves at a second velocity at a second boundary between the follower roller and the endless belt. The second velocity provides a second fluctuation. A transmission parameter with respect to at least one of the drive roller, the follower roller and the endless belt is set so that the second fluctuation is smaller than the first fluctuation.

24 Claims, 4 Drawing Sheets

(a)

(b)

(a)

(b)

(c)

BELT UNIT AND IMAGE-FORMING DEVICE HAVING THE SAME

CROSS REFERENCE TO RELATED APPLICATIONS

This application claims priority to Japanese Patent Application No. 2005-080240 filed on Mar. 18, 2005, the contents of which are hereby incorporated by reference into the present application.

TECHNICAL FIELD

The present invention relates to a belt unit including a drive roller, a follow roller, and a flexible belt looped around the drive roller and follow roller; and an image-forming device employing this belt unit for forming images.

BACKGROUND

Some image-forming devices employ a belt unit for conveying a recording medium on which images are formed. This belt unit generally includes a drive roller and a follow roller, and a conveying belt looped around the drive roller and follow roller. However, it is difficult to form conveying belts with a uniform thickness over the entire length and, consequently, the belt units must employ conveying belts having a variable thickness component.

However, in a structure that transfers the driving force of the drive roller unchanged to the follow roller via a conveying belt having such inherent variations, the variations in the thickness component will translate to variations in the driving speed transferred to the follow roller. These variations in driving speed will cause the recording medium to be conveyed at an uneven speed.

When such a belt unit is incorporated in an image-forming device having image-forming units disposed along a conveying direction, the irregular conveying speed will shift the position of images recorded by individual image-forming units in the conveying direction, leading to a decline in the quality of the overall image formed on the recording medium. This decline in image quality is more pronounced as the distance between the image-forming units becomes great.

Currently, technologies have been proposed for preventing this drop in image quality. For example, Japanese unexamined patent application publication No. 2003-173067 proposes a technique for controlling the rotational speed of a driving motor that drives the drive roller to rotate based on variations in the thickness component of the conveying belt (variations in thickness with respect to the length of the belt).

However, this technology requires changing parameters of the belt unit for conveying the recording medium, such as the rotational speed of the drive roller, in real time in response to changes in the thickness component of the conveying belt. Therefore, a great process load is placed on controlling the driving motor in order to change these parameters.

SUMMARY

In view of the foregoing, it is an object of the present invention to provide an image-forming device capable of suppressing unevenness of a conveying speed by a belt unit and, hence, suppressing a drop in image quality, without varying parameters of the belt unit for conveying the recording medium in real time.

In order to attain the above and other objects, the present invention provides a belt unit includes a drive roller that rotates upon receiving a driving force from a drive motor, a follower roller rotatable as a result of rotation of the drive roller and an endless belt looped around the drive roller and follower roller, and formed of a resilient material. The drive roller transfers a first force based on the driving force to the endless belt to circularly move at a first velocity at a first boundary between the drive roller and the endless conveying belt. The first velocity provides a first fluctuation. The endless belt transfers a second force based on the first force to the follower roller to rotate. The endless belt moves at a second velocity at a second boundary between the follower roller and the endless belt. The second velocity provides a second fluctuation. A transmission parameter with respect to at least one of the drive roller, the follower roller and the endless belt is set so that the second fluctuation is smaller than the first fluctuation.

Another aspect of the present invention provides an image-forming device includes a drive roller that rotates upon receiving a driving force from a drive motor, a follower roller rotatable as a result of rotation of the drive roller and an endless belt looped around the drive roller and follower roller, and formed of a resilient material. The drive roller transfers a first force based on the driving force to the endless belt to circularly move at a first velocity at a first boundary between the drive roller and the endless conveying belt. The first velocity provides a first fluctuation. The endless belt transfers a second force based on the first force to the follower roller to rotate. The endless belt moves at a second velocity at a second boundary between the follower roller and the endless belt. The second velocity provides a second fluctuation. A transmission parameter with respect to at least one of the drive roller, the follower roller and the endless belt is set so that the second fluctuation is smaller than the first fluctuation.

BRIEF DESCRIPTION OF THE DRAWINGS

The above and other objects, features and advantages of the invention will become more apparent from reading the following description of the preferred embodiments taken in connection with the accompanying drawings in which:

FIG. 2(*b*) is a graph showing a cumulative follow displacement derived from an Equation 2;

DETAILED DESCRIPTION OF THE PREFERRED EMBODIMENTS

Figure 1:
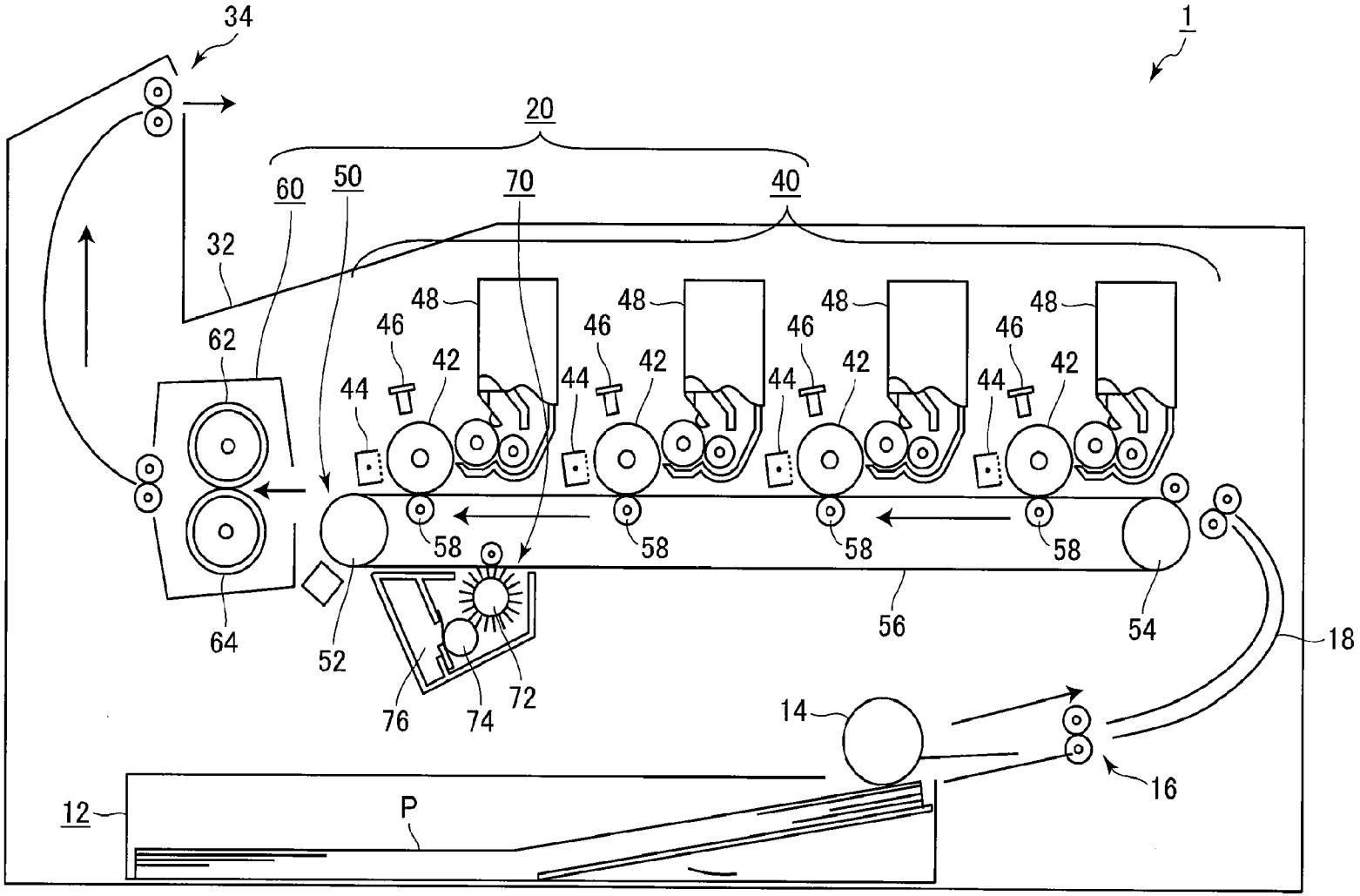
FIG. 1 is a side cross-sectional view showing the internal structure of a color laser printer according to the preferred embodiment of the present invention.

An image-forming device according to preferred embodiments of the present invention will be described while referring to the accompanying drawings wherein like parts and components are designated by the same reference numerals to avoid duplicating description.

In the following description, the expressions "front", "rear", "upper", "lower", "right", and "left" are used to define the various parts when the image-forming device is disposed in an orientation in which it is intended to be used.

1. General Structure of a Color Laser Printer

FIG. 1 shows a color laser printer 1 serving as the image-forming device of the preferred embodiment. The printer 1 includes a paper tray 12 that is detachably mounted in the printer 1 and accommodates a recording paper p; a feeding roller 14 for picking up and feeding the recording paper p loaded in the paper tray 12 one sheet at a time; a pair of conveying rollers 16 for conveying the sheets of recording paper p fed by the feeding roller 14; a guiding path 18 for guiding the sheets of recording paper p conveyed by the conveying rollers 16; an image-forming section 20 for forming an image on the recording paper p being conveyed along the guiding path 18; and a pair of discharge rollers 34 for discharging the recording paper p onto a discharge tray 32 after the image-forming section 20 has an image on the recording paper p. All of these components are accommodated in a main casing of the printer 1.

The image-forming section 20 includes image-forming units 40 for forming images on the recording paper p; a belt unit 50 for conveying the recording paper p conveyed along the guiding path 18 through transfer positions at which the image-forming units 40 form images on the recording paper p; a fixing unit 60 for fixing the image transferred to the recording paper p onto the recording paper p with heat and pressure; and a cleaning unit 70 for cleaning the belt unit 50.

A plurality of the image-forming units 40 is disposed along the direction in which the belt unit 50 conveys the recording paper p (indicated by arrows in FIG. 1). Each image-forming unit 40 includes a photosensitive drum 42, a charger 44 for charging the photosensitive drum 42, an exposure device 46 for forming an electrostatic latent image on the photosensitive drum 42, and a developing unit 48 for depositing developer on the photosensitive drum 42 to developer the electrostatic latent image into a developer image.

With this construction, each exposure device 46 forms an electrostatic latent image on the photosensitive drum 42 that is developed into a developer image by the developing unit 48. This developer image is transferred onto the recording paper p, as the recording paper p is conveyed by the belt unit 50, forming an image on the recording paper p. Each of the image-forming units 40 can form an image in a different color (cyan, magenta, yellow, and black in the preferred embodiment).

The charger 44 of the image-forming unit 40 is a positive-charging Scorotron charger, for example, having a charging wire formed of tungsten or the like that generates a corona discharge to charge the entire surface of the photosensitive drum 42 with a positive polarity. The exposure device 46 is configured of a laser light-emitting unit for generating a laser beam, lenses, and the like and functions to form an electrostatic latent image on the surface of the photosensitive drum 42. Most of the exposure device 46 is not shown in FIG. 1, only the section through which the laser beam is ultimately outputted.

With this exposure device 46, the laser light-emitting unit emits a laser beam that is scanned over the surface of the photosensitive drum 42 to form an electrostatic latent image thereon. The latent image carried on the surface of the photosensitive drum 42 is subsequently developed by developer supplied from the developing unit 48. The developed image is then transferred onto the recording paper p, as the recording paper p is conveyed along the belt unit 50, to form an image on the surface of the recording paper p.

The image-forming units 40 are disposed along the belt unit 50 so that nip portions between the photosensitive drums 42 and the belt unit 50 (more specifically, transfer rollers 58) are formed at intervals equivalent to n times the period of a fluctuation component in the drive velocity transferred from a drive roller 52 to a follow roller 54 described later (where n is any integer; in the preferred embodiment, n is 1).

The image-forming units 40 are arranged in the order magenta, cyan, yellow, and black beginning from the upstream end in the direction that the belt unit 50 conveys the recording paper p. This arrangement positions the image-forming units 40 that form cyan, magenta, and yellow images closer to the follow roller 54 and, hence, farther from the drive roller 52, because these image-forming units 40 are more frequently used for rendering different colors by forming pixels at positions adjacent to or overlapping pixels formed by other image-forming units 40.

The belt unit 50 is disposed in the conveying path of the recording paper p. The belt unit 50 includes the drive roller 52, which rotates upon receiving a driving force from a drive motor (not shown); the follow roller 54 disposed on the upstream end in the paper-conveying direction; an endless conveying belt 56 that is looped around the drive roller 52 and follow roller 54; and the transfer rollers 58 disposed at positions along the inside of the conveying belt 56 opposing the photosensitive drums 42 therethrough.

The thickness of the conveying belt 56 along the length thereof fluctuates within a fixed range (± several μm). Consequently, the drive velocity transferred from the drive roller 52 to the follow roller 54 via the conveying belt 56 includes a fluctuation component. The conveying belt 56 in the preferred embodiment does not directly receive an image transferred onto the surface thereof, but functions as a transfer belt for transferring an image to the recording paper p.

The fluctuation component in the drive velocity generates a cumulative displacement, that is, deviation in the amount that the recording paper p is conveyed by the conveying belt 56. However, the conveying belt 56 according to the present invention is elastic and, hence, stretches and contracts when receiving a driving force from the drive roller 52. Accordingly, the conveying belt 56 can absorb the fluctuation component and can transmit the driving force to the follow roller 54, thereby reducing the cumulative displacement and attenuating deviation in the conveying amount.

Here, cumulative displacement is defined as a cumulative amount of deviation in the conveying amount produced when the conveying belt 56 travels one complete circuit along with the rotation of the drive roller 52. However, since the conveying belt 56 is provided between the drive roller 52 and the follow roller 54, it should be apparent that the cumulative displacement at the drive roller 52 (hereinafter referred to as the "cumulative drive displacement") will differ from the cumulative displacement at the follow roller 54 (hereinafter referred to as the "cumulative follow displacement").

More specifically, the cumulative drive displacement can be found by the following Equation 1 based on the surface velocity Va(t) (=V(t)+Vb) of the conveying belt 56 at the drive roller 52 and the time-averaged surface velocity Vb. V(t) is a fluctuation component in the drive velocity, and varies in accordance with variation of "t". The time-averaged surface velocity Vb is constant. The fluctuation component V(t) in the drive velocity plus the time-averaged surface velocity Vb is the surface velocity Va(t). Further, the cumulative follow displacement can be found from Equation 2 below based on the cumulative drive displacement at the drive roller 52 and the maximum cumulative drive displacement (hereinafter referred to as the "amplitude of cumulative displacement").

$$\text{Cumulative drive displacement} = \int (Va(t) - Vb)dt = \int (V(t))dt \quad \text{(Equation 1)}$$

Cumulative follow displacement=cumulative drive displacement·(amplitude of cumulative displacement·2−belt elongation/(amplitude of cumulative displacement·2) (Equation 2)

Figure 2:
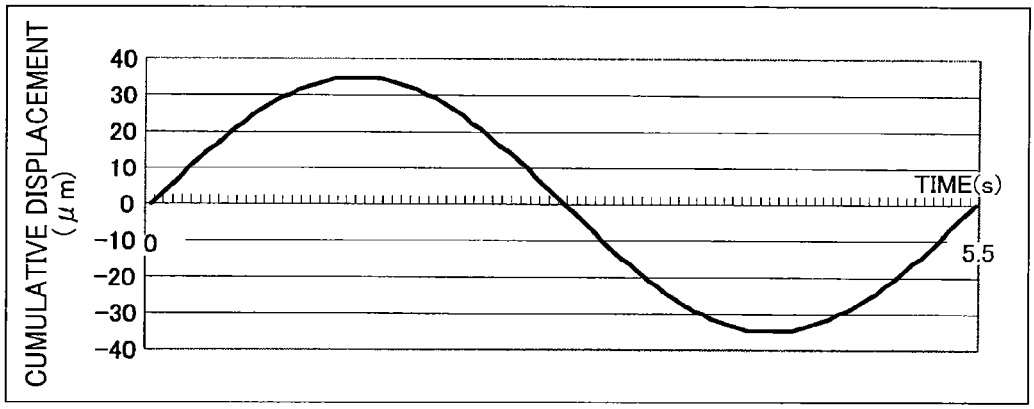
FIG. 2(*a*) is a graph showing a cumulative drive displacement found from an Equation 1.
Figure 2:
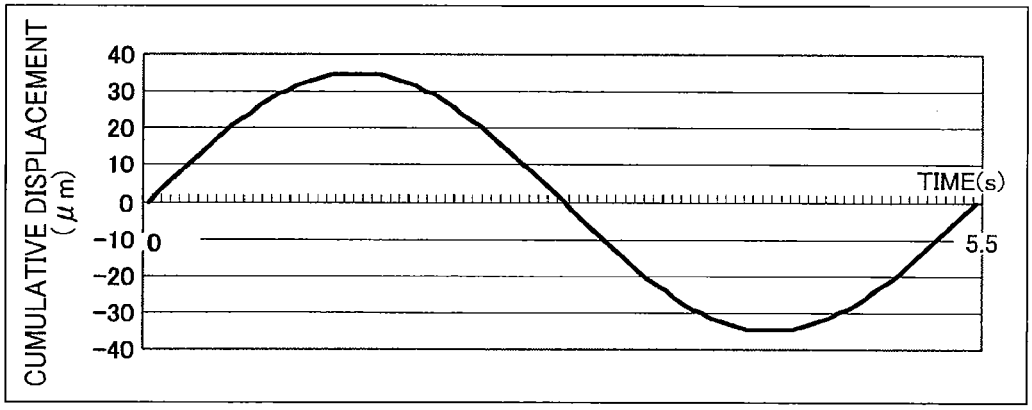

If the time-averaged surface velocity Vb is 119 mm/sec, and the surface velocity Va(t) is a cosine wave (V(t)) plus the time-averaged surface velocity Vb, the cosine wave (V(t)) having an amplitude of 0.035 mm/sec and a period of 5.5 sec, the cumulative drive displacement in the preferred embodiment is 70 μm. Note that 1 mm corresponds to 1000 μm. Assuming that the elongation of the belt is 0, the cumulative follow displacement would be 70 μm since the amplitude of cumulative displacement is 35 μm. FIG. 2(*a*) is a graph showing the cumulative drive displacement found from Equation 1, and FIG. 2(*b*) is a graph showing the cumulative follow displacement found from Equation 2. The amplitude in FIG. 2(*b*) does not vary, that is, the cumulative drive displacement is equal to the cumulative follow displacement, since the elongation is 0.

The "elongation" in Equation 2 indicates the amount that the conveying belt 56 stretches due to the load component produced in the area of contact between the conveying belt 56 and follow roller 54 when the drive roller 52 rotates.

As can be seen from Equation 2, the cumulative follow displacement is smaller when the elongation of the belt is greater, that is, when the conveying belt 56 is more elastic. This indicates that elongation of the belt can absorb the fluctuation component and reduce deviation in the conveying amount. However, if the elongation is too large, creep may occur in the conveying belt 56 itself, resulting in the conveying belt 56 remaining in an elongated state, or the conveying belt 56 may come off the belt unit 50 when skewed. Hence, it is preferable that the conveying belt 56 has an amount of elongation sufficient to ensure a degree of stiffness.

Therefore, parameters should be set to satisfy the following Equation 3 in which ΔL (m) is the belt elongation, and A (m) is the maximum amplitude of the cumulative drive displacement during one circuit of the conveying belt 56 when driven by the rotation of the drive roller 52.

$$(1/2)\cdot A<\Delta L<A \qquad \text{(Equation 3)}$$

Since the cumulative drive displacement is 70 μm in the preferred embodiment, the elongation ΔL should be selected to satisfy the relationship 35 μm<ΔL<70 μm, as is described below.

The elongation ΔL is calculated based on the following Equation 4, where δ (Pa) is the stress that the drive roller 52 applies to the conveying belt 56, E (Pa) is Young's modulus for the belt, and L (m) is the belt length.

$$\Delta L=\delta/(E\cdot L) \qquad \text{(Equation 4)}$$

The stress δ can be found from Equation 5, where N (N) is the rotational resistance (belt load) between the drive roller 52 and the conveying belt 56 moving with the rotation of the drive roller 52, W (m) is the width of the belt, and T (m) is the thickness of the belt. By substituting Equation 5 into Equation 4, the elongation ΔL can be represented by Equation 6 below.

$$\delta=N/(W\cdot T) \qquad \text{(Equation 5)}$$

$$\Delta L=(N\cdot L)/(E\cdot W\cdot T) \qquad \text{(Equation 6)}$$

In the preferred embodiment, parameters for Equation 6 are selected to obtain a low cumulative follow displacement in Equation 2 described above when the elongation ΔL computed from Equation 6 is substituted into Equation 2. In this way, variations in the amount of conveyance can be reduced below a resolution that can be detected by the human eye.

Here, a resolution of 50 μm was found to be the threshold at which the human retina can no longer perceive deviation in a recording paper p on which the printer 1 has formed an image when the recording paper p is held 300 mm away from the eye. Hence, the "resolution that can no longer be perceived by the human eye" should be smaller than 50 μm. The resolution of 50 μm is found through Dolly's approximation as the limit of perception with the human retina at a distance of 300 mm, which is the standard observation distance specified in ISO 13660 (see, for example, *Fine Imaging and Hardcopy*, first edition, the Society of Photographic Science and Technology of Japan and the Imaging Society of Japan, Corona Publishing Co., Ltd., Jan. 7, 1999, p. 527). Through this method, it is possible to reliably reduce the amount of deviation in conveyance when conveying a recording medium based on the fluctuation component to a resolution that cannot be perceived by the human eye.

In the preferred embodiment, an elongation ΔL of about 50 μm is used by setting the belt load N to 6 N, the belt width W to 0.25 m, the belt thickness T to 150 μm, the belt length L to 0.3 m, and the Young's modulus E of the belt to 1000 MPa (where (6·0.3)/(1000·0.25·150 (μm))=48 μm, approximately equivalent to 50 μm). Hence, if the cumulative drive displacement is 70 μm, the elongation ΔL of 50 μm satisfies the relationship in Equation 3 (35 μm<ΔL<70 μm). Further, the cumulative follow displacement from Equation 2 is 70·((35·2−50)/(35·2))=20 μm, which is lower than the 50 μm limit of human perception at 300 mm.

In selecting Young's modulus E for the belt, a plurality of conveying belts 56 were formed of materials with differing Young's moduli to determine how the cumulative displacement of the fluctuation component in velocity transmitted from the drive roller 52 to the follow roller 54 (in other words, the cumulative follow displacement) varied in response to the Young's modulus. E of each conveying belt 56. The Young's modulus E used in the present embodiment was then selected based on the results from Equations 2 and 6 described above. Based on these equations, as the Young's modulus E increases, the amount of variation in conveyance that can be absorbed by the elongation ΔL grows smaller, and the cumulative follow displacement increases. In other words, it becomes increasingly difficult for the conveying belt 56 to attenuate deviations in conveyance amounts when conveying the recording paper p. Therefore, it is desirable to select a Young's modulus that can increase the elongation as much as possible within the range that satisfies Equation 3.

In the preferred embodiment, the above equations were used to find the cumulative follow displacement in conveying belts 56 formed of a rigid body with a Young's modulus of 100,000 MPa, polycarbonate with a Young's modulus of 3,000 MPa, and elastomer with a Young's modulus of 1,000 MPa. Based on these results, the elongation ΔL was about 20 μm for material having a Young's modulus of 3,000 MPa or less and about 50 μm (see above) for material having a Young's modulus of 1,000 MPa or less. When the cumulative drive displacement is 70 μm, the cumulative follow displacement found from Equation 2 is 20 μm for the material with a Young's modulus of 1,000 MPa and 50 μm for the material with a Young's modulus of 3,000 MPa, both of which values are within the range that the human retina cannot perceive from a distance of 300 mm.

Figure 3:
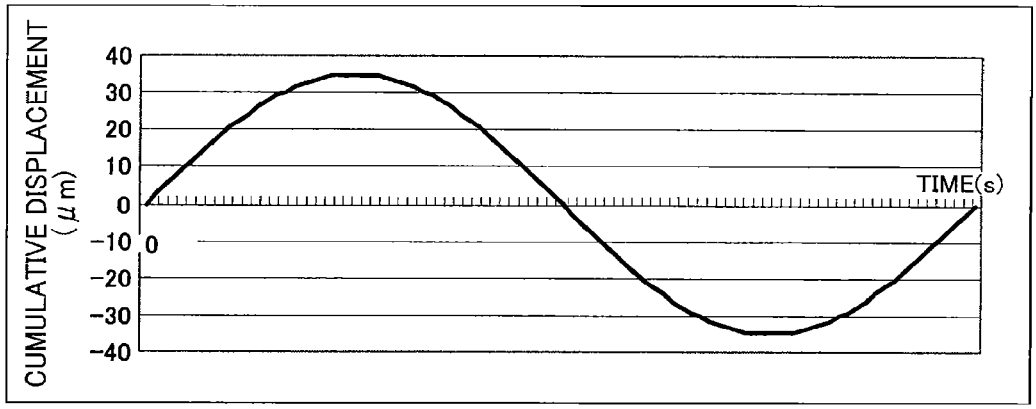
FIGS. 3(*a*), 3(*b*), and 3(*c*) are graphs showing the cumulative follow displacement for a flexible belt formed of materials with differing Young's moduli.
Figure 3:
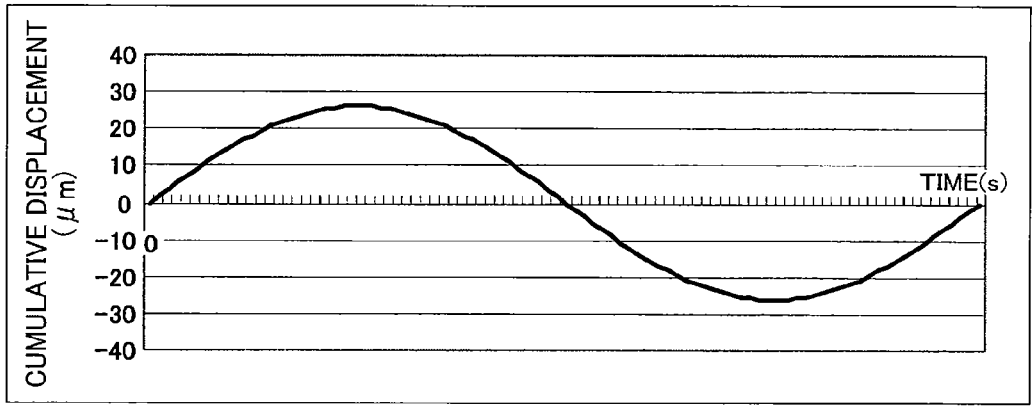
Figure 3:
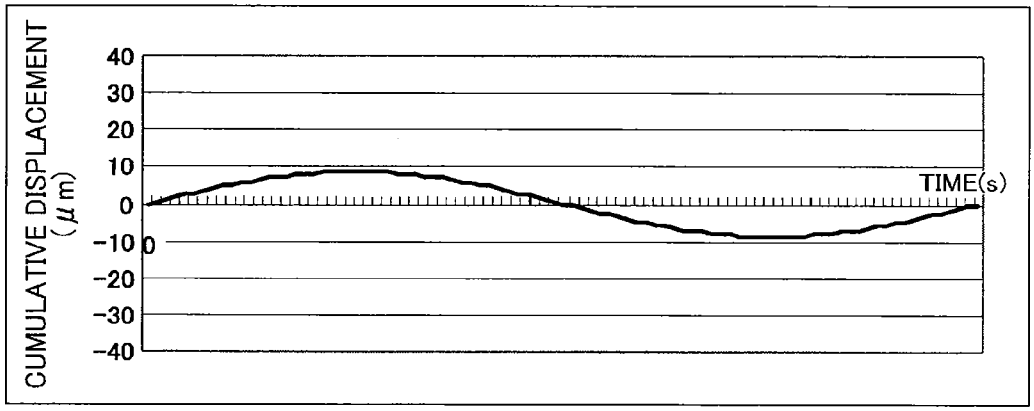

FIG. 3(*a*) shows the cumulative follow displacement found from the above equations for the conveying belt 56 formed of a rigid body with a Young's modulus of 100,000 MPa. FIG. 3(*b*) shows the cumulative follow displacement found from the above equations for the conveying belt 56 formed of polycarbonate with a Young's modulus of 3,000 MPa. FIG. 3(*c*) shows the cumulative follow displacement found from the above equations for the conveying belt 56 formed of elastomer with a Young's modulus of 1,000 MPa.

Returning to FIG. 1, the fixing unit 60 includes a heating roller 62 configured of a metal tube with a release layer formed on the surface thereof, and a halogen lamp disposed inside the metal tube along the axial direction thereof; and a pressure roller 64 for pressing the recording paper p conveyed by the belt unit 50 against the heating roller 62 and conveying the recording paper p toward the discharge rollers 34 in cooperation with the heating roller 62. At this time, the halogen lamp accommodated in the heating roller 62 heats the surface of the heating roller 62 to a fixing temperature that is sufficient for fixing the developer images on the recording paper p.

The cleaning unit 70 is disposed in opposition to a surface of the belt unit 50 on the side opposite the image-forming units 40. The cleaning unit 70 includes a brush 72 disposed in contact with the outer surface of the conveying belt 56, a secondary roller 74 opposing the brush 72 on a lower side thereof, and a recovery section 76 formed adjacent to the secondary roller 74. With this construction of the cleaning unit 70, the brush 72 in contact with the conveying belt 56 collects toner and other matter deposited on the surface of the conveying belt 56 as the conveying belt 56 is driven by the drive roller 52. The secondary roller 74 recovers this matter collected by the brush 72 and deposits the matter in the recovery section 76.

2. Operations and Effects

With the printer 1 having the construction described above, parameters related to the belt unit 50 conveying the recording paper p are selected so that the fluctuation component included in the drive velocity transferred from the drive roller 52 to the follow roller 54 is at least smaller than the fluctuation component at the point when the driving force of the drive roller 52 is transferred to the conveying belt 56. Specifically, the parameters indicates stretch property of the conveying belt 56 such that the conveying belt 56 should be stretchable and be capable of receiving a driving force from the drive roller 52 and transferring the driving force to the follow roller 54 while stretching and contracting to absorb the fluctuation component.

Hence, even when the drive velocity transferred from the drive roller 52 to the follow roller 54 includes a fluctuation component due to variation in the thickness component of the conveying belt 56, the fluctuation component is reduced by the time the driving force is transferred to the follow roller 54. Accordingly, the printer 1 of the preferred embodiment can reduce unevenness of the conveying speed at which the belt unit 50 conveys the recording paper p, without imposing a control load on the drive motor in a real-time control process for canceling the fluctuation component of the drive velocity.

When unevenness in the conveying speed is suppressed in this way, achieving a stable conveying speed, there is less chance that the position of the images recorded by the image-forming units 40 will deviate in the conveying direction. As a result, the printer 1 can suppress a decline in the quality of images formed on the recording paper p.

Further, the parameters in Equation 6 described above are chosen to be able to attenuate the cumulative follow displacement to a sufficient degree that deviations in the conveying amount are smaller than a resolution that can be perceived by the human eye. Accordingly, even when a deviation in the conveying amount occurs, the amount of deviation will be sufficiently small as to be undetectable by the naked eye.

At this time, the cumulative follow displacement is kept smaller than 50 μm, which is found through Dolly's approximation to be the limit at which resolution becomes undetectable by the human retina at a distance of 300 mm for a recording paper p on which the printer 1 has formed an image. Accordingly, even if positional deviations of individual pixels are produced due to deviations in the amount of conveyance, these deviations cannot be detected from a distance of 300 mm, thereby preventing a perceivable decline in image quality.

In the printer 1 described above, the image-forming units 40 (more specifically the photosensitive drums 42) are disposed at intervals equivalent to an n-multiple of the period of the fluctuation component included in the drive velocity transferred from the drive roller 52 to the follow roller 54.

Accordingly, the drive velocity transferred from the drive roller 52 to the follow roller 54 fluctuates n periods in each interval between the image-forming units 40 (between nip parts between the conveying belt 56 and photosensitive drums 42). Therefore, the speed at which the belt unit 50 conveys the recording paper p similarly fluctuates n periods in each interval between the image-forming units 40. As a result, when the belt unit 50 conveys the recording paper p, the speed at which the recording paper p passes a nip part at each image-forming unit 40 fluctuates in the same (or approximately the same) manner.

In other words, even if the position at which each single-color image should be recorded by each image-forming unit 40 deviates in the conveying direction, a similar deviation occurs when the recording paper p passes through the nip parts of each image-forming unit 40. Accordingly, the entire image is shifted out of position and no single image of any color constituting the entire image is greatly shifted from the others. Hence, this construction can prevent a decline in the quality of the image formed on the recording paper p.

Further, of the plurality of image-forming units 40, the image-forming units 40 for forming images in cyan, magenta, and yellow are disposed as near to the follow roller 54 as possible and farther away from the drive roller 52.

Figure 4:
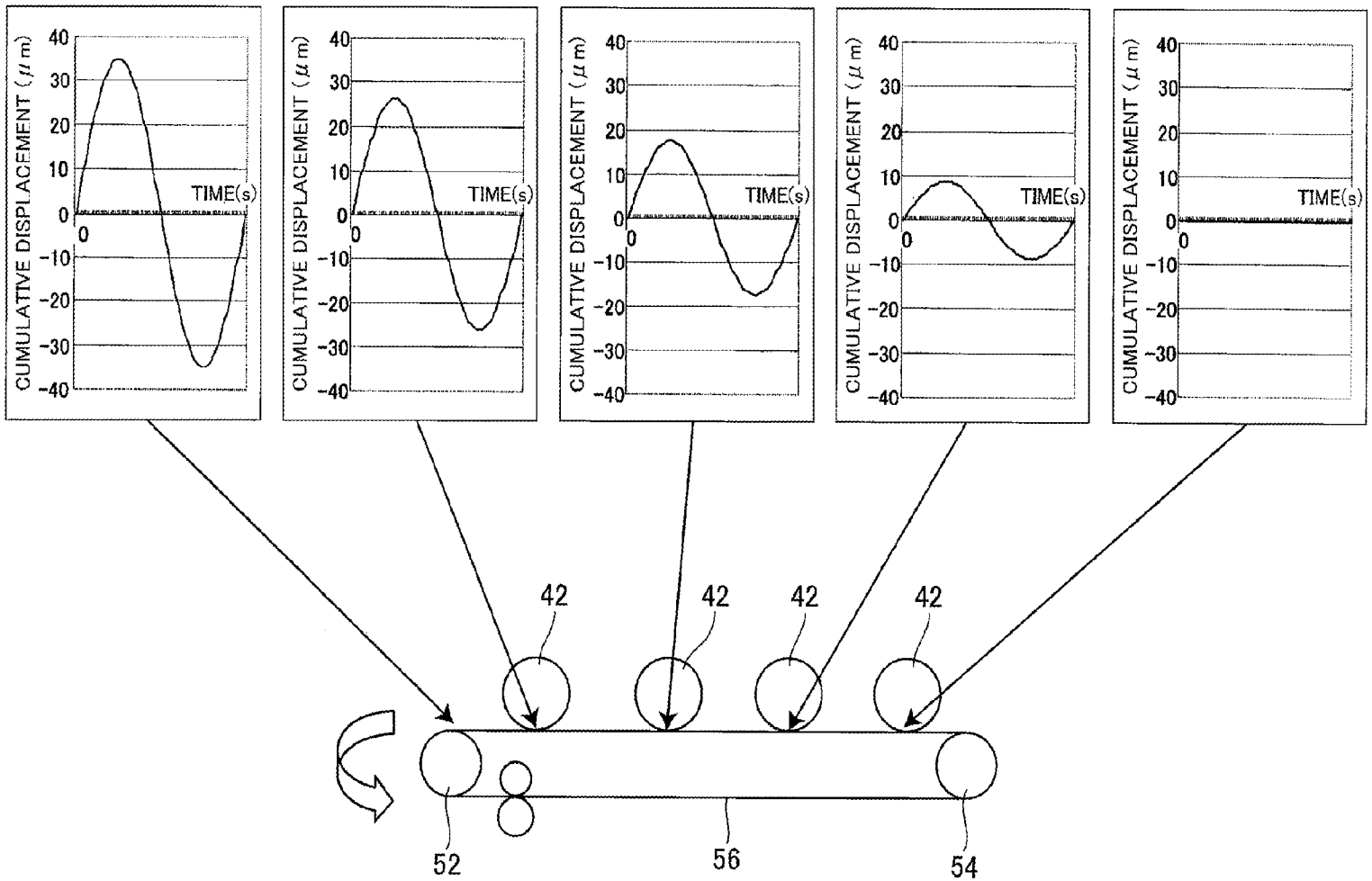
FIG. 4 is an explanatory diagram showing variations in cumulative displacement at the positions of each image-forming unit.

Normally, the fluctuation component in the drive velocity grows smaller away from the drive roller 52. The effects of deviation caused by this fluctuation component are smaller for image-forming units 40 positioned nearest the follow roller 54. FIG. 4 shows changes in the cumulative displacement at each position of the image-forming units 40. Some of the image-forming units 40 are more frequently employed in such applications as rendering different colors by forming pixels at positions adjacent to or overlapping pixels formed by other image-forming units 40. The more that pixels formed by these image-forming units 40 deviate in position due to the fluctuation component, the greater the deviation with pixels formed by other image-forming units 40 and the greater the likelihood that the desired color will not be rendered properly. Hence, it is desirable that these image-forming units 40 not be affected by deviations caused by the fluctuation component.

Accordingly, as described above, image-forming units 40 that are more frequently used for rendering different colors and the like are disposed at positions near the follow roller 54. This configuration can prevent problems in rendering an appropriate color when an image is formed by two or more image-forming units 40.

Further, image-forming units 40 that have a low frequency of use in rendering separate colors in combination with other image-forming units 40, in other words, the image-forming unit 40 for forming black images, are disposed in a position nearest the drive roller 52.

Normally, the fluctuation component in the drive velocity is greatest at distances nearest the drive roller 52. Therefore, the image-forming units 40 positioned nearer the drive roller 52 are more influenced by deviations caused by the fluctuation component. Further, the image-forming unit 40 used to form black images that are less frequently used in application for rendering different colors is greatly affected by deviations caused by the fluctuation component. However, since the images formed by this image-forming unit 40 are not often used for rendering different colors, even if the images formed by this image-forming unit 40 deviate greatly from images formed by other image-forming units 40, this deviation will not have a great influence on the rendering of different colors since images of the different colors are formed by other image-forming units 40. Rather, by disposing this image-forming unit 40 in a position near the drive roller 52, it is possible to position the other image-forming units 40 farther away from the drive roller 52. Accordingly, the image-forming units 40 most frequently used for representing different colors will suffer from less deviation in position and, hence, will be able to render the different colors appropriately.

3. Variations of the Embodiment

While the invention has been described in detail with reference to specific embodiments thereof, it would be apparent to those skilled in the art that many modifications and variations may be made therein without departing from the spirit of the invention, the scope of which is defined by the attached claims.

For example, in the preferred embodiment described above, the present invention is applied to a color laser printer. However, the present invention may be applied to another device other than a color laser printer, provided that the device includes a belt unit having a drive roller and a follow roller, and a conveying belt looped around the drive roller and follow roller.

Further, in the preferred embodiment described above, the conveying belt 56 employed in the belt unit 50 is formed of a material selected based on its Young's modulus. However, the conveying belt 56 may instead be selected based on a factor other than Young's modulus.

For example, the conveying belt 56 could be selected based on a cross-sectional area in a direction orthogonal to the length of the conveying belt 56 (W·T in Equation 6). In other words, since the conveying belt 56 is more stretchable with a smaller cross-sectional area, it is possible to select a conveying belt 56 by adjusting or theoretically calculating (through Equation 6) a cross-sectional area that minimizes the degree of the fluctuation component transferred to the follow roller 54 within a range that sufficiently maintains the function and strength of the conveying belt 56. By selectively setting the cross-sectional area of the conveying belt 56 in this way, it is possible to achieve a conveying belt 56 that is more flexible and capable of transferring a driving force from the drive roller 52 to the follow roller 54 while stretching and contracting to absorb the fluctuation component.

It is also conceivable to select the conveying belt 56 based on the length of the conveying belt 56. Specifically, since a longer conveying belt 56 is more stretchable, it is possible to select a conveying belt 56 by adjusting or theoretically calculating (through Equation 6) a length (L in Equation 6) that minimizes the amount of the fluctuation component transmitted to the follow roller 54 within an allowable range in the belt unit 50 and, consequently, the printer 1. By selecting the conveying belt 56 by its length in this way, it is possible to achieve a conveying belt 56 that is more flexible and capable of transferring a driving force from the drive roller 52 to the follow roller 54 while stretching and contracting to absorb the fluctuation component.

In the preferred embodiment described above, the "stretch property" of the conveying belt 56 is achieved merely through physical properties of the conveying belt 56 (Young's modulus). However, the stretch property of the conveying belt 56 may be achieved through another means than the physical properties of the conveying belt 56.

One such means could be configured by applying a load component (N in Equation 6) to the conveying belt 56 when the drive roller 52 drives the conveying belt 56. The load component applied to the conveying belt 56 serves as a resistance that pulls on the conveying belt 56 and generates stretch therein when the drive roller 52 is driven. Hence, it is possible to make the conveying belt 56 more stretchable by applying a greater load component thereto within a range that the drive roller 52 can drive the conveying belt 56. Hence, it is possible to achieve the stretch property in the conveying belt 56 described above by measuring or theoretically calculating (through Equation 6) a load component to apply to the conveying belt 56, in addition to using the physical properties of the conveying belt 56.

One conceivable method of applying this load component is with the cleaning unit 70. In this case, the brush 72 of the cleaning unit 70 can be configured to press against the conveying belt 56 with a prescribed pressure and to rotate at a prescribed speed in a direction opposite the conveying direction of the conveying belt 56 to apply a load component to the conveying belt 56.

In this construction, the cleaning unit 70 not only serves to clean the surface of the conveying belt 56, but also functions to apply a load component for producing stretch property in the conveying belt 56. Here, it should be apparent that the cleaning device is not limited to the brush 72, but may be configured of a cleaning roller, blade, or the like.

The load component described above may also be applied through the follow roller 54. In this case, the follow roller 54 may generate a prescribed rotational load when rotating that applies a load component to the conveying belt 56.

With this construction, the follow roller 54 not only functions as part of the belt unit 50, but also as a load component for producing stretch property in the conveying belt 56.

The load component described above may also be applied through the image-forming units 40. In this case, the photosensitive drums 42 may be configured to press against the conveying belt 56 with a prescribed pressure and to rotate at a speed slightly slower than the conveying speed of the conveying belt 56, thereby applying a load component to the conveying belt 56.

With this construction, the photosensitive drums 42 not only function to record images on the recording paper p, but also to apply a load component for producing stretch property in the conveying belt 56.

The load component described above may be applied to the conveying belt 56 through only one of the means described above or may be distributed over a plurality of means. Further, the stretch property of the conveying belt 56 described above may be achieved using only a load component and not through the physical properties of the conveying belt 56.

In the preferred embodiment described above, image-forming units 40 used for rendering different colors together with colors of images formed by other image-forming units 40 are positioned as close as possible to the follow roller 54 and separated from the drive roller 52. Accordingly, in the preferred embodiment, the image-forming units 40 are arranged in the order magenta, cyan, yellow, and black in the direction that the belt unit 50 conveys the recording paper p. However, the present invention is not particularly limited to any arrangement of the image-forming units 40 provided that the image-forming units 40 for magenta, cyan, and yellow are positioned as near as possible to the follow roller 54 and separated from the drive roller 52. For example, it is conceivable to lengthen the path along which the belt unit 50 conveys the recording paper p and to dispose the image-forming units 40 at positions separated as far as possible from the drive roller 52.

In the preferred embodiment described above, the present invention is applied to a direct tandem type printer in which the image-forming units 40 transfer developer images directly to the recording paper p conveyed on the belt unit. However, the structure of the present invention may also be applied to a printer other than a direct tandem type printer, such as an intermediate transfer tandem type of a four-cycle type printer in which the conveying belt 56 functions as an intermediate transfer belt and performs a secondary transfer to transfer an image onto the recording paper p after a primary transfer in which developer images from the image-forming unit 40 are directly or indirectly transferred onto the intermediate transfer belt.

What is claimed is:

1. A belt unit comprising:

a drive roller that rotates upon receiving a driving force from a drive motor;

a follower roller rotatable as a result of rotation of the drive roller; and an endless belt looped around the drive roller and follower roller, and formed of a resilient material, wherein the drive roller transfers a first force based on the driving force to the endless belt to circularly move at a first velocity at a first boundary between the drive roller and the endless belt, the first velocity providing a first fluctuation, wherein the endless belt transfers a second force based on the first force to the follower roller to rotate, the endless belt moving at a second velocity at a second boundary between the follower roller and the endless belt, the second velocity providing a second fluctuation, wherein a transmission parameter with respect to at least one of the drive roller, the follower roller and the endless belt is set so that the second fluctuation is smaller than the first fluctuation, wherein the endless belt has a stretch property, wherein the transmission parameter is set so that the endless belt transfers the second force while stretching and contracting to absorb the second fluctuation, and wherein the transmission parameter is set so that the following relationship is established:

$$(1/2)\cdot A<\Delta L<A$$

in which A: a maximum amplitude of cumulative displacement during one circuit of the endless belt, and ΔL: a difference of a length of the endless belt from a natural length is indicated.

2. The belt unit according to claim 1, wherein the transmission parameter is set so that when an image is formed on the endless belt or a recording medium on the endless belt, deviation of the image that occurs due to both of the first fluctuation and the second fluctuation is smaller than deviation that a human retina can perceive.

3. The belt unit according to claim 2, wherein the transmission parameter is set so that the deviation of the image is smaller than 50 μm that is a threshold at which the human retina can no longer perceive the deviation of the image when the image is held 300 mm away from the human retina.

4. The belt unit according to claim 1, wherein the endless belt has a specific Young's modules capable of performing stretching and contracting to absorb the second fluctuation.

5. The belt unit according to claim 1, wherein the endless belt has a cross-sectional area in a thickness direction, wherein the stretch property is based on the cross-sectional area.

6. The belt unit according to claim 1, wherein the endless belt has a length over one loop, wherein the stretch property is based on the length.

7. The belt unit according to claim 1, wherein the drive roller and the endless belt provides a predetermined friction in order to realize stretching and contracting of the endless belt, when the drive roller drives the endless belt.

8. The belt unit according to claim 1, further comprising a cleaning unit that contacts a surface of the endless belt to clean the surface of the endless belt, wherein the cleaning unit applies a load to the endless belt in order to realize stretching and contracting of the endless belt, when the cleaning unit contacts the surface of the endless belt.

9. The belt unit according to claim 1, wherein the follower roller and the endless belt provides a predetermined friction in order to realize stretching and contracting of the endless belt, when the second force is transferred from the endless belt to the follower roller.

10. The belt unit according to claim 1, wherein the endless belt is used to transfer an image formed on the endless belt to a recording medium.

11. An image-forming device comprising:

a drive roller that rotates upon receiving a driving force from a drive motor;

a follower roller rotatable as a result of rotation of the drive roller; and an endless belt that is looped around the drive roller and follower roller, and formed of a resilient material, wherein the drive roller transfers a first force based on the driving force to the endless belt to circularly move at a first velocity at a first boundary between the drive roller and the endless belt, the first velocity providing a first fluctuation, wherein the endless belt transfers a second force based on the first force to the follower roller to rotate, the endless belt moving at a second velocity at a second boundary between the follower roller and the endless belt, the second velocity providing a second fluctuation, wherein a transmission parameter with respect to at least one of the drive roller, the follower roller and the endless belt is set so that the second fluctuation is smaller than the first fluctuation, wherein the endless belt has a stretch property, wherein the transmission parameter is set so that the endless belt transfers the second force while stretching and contracting to absorb the second fluctuation, and wherein the transmission parameter is set so that the following relationship is established:

$$(1/2)\cdot A<\Delta L<A$$

in which A: a maximum amplitude of cumulative displacement during one circuit of the endless belt, and ΔL: a difference of a length of the endless belt from a natural length is indicated.

12. The image-forming device according to claim 11, wherein the transmission parameter is set so that when an image is formed on the endless belt or a recording medium on the endless belt, deviation of the image that occurs due to both of the first fluctuation and the second fluctuation is smaller than deviation that a human retina can perceive.

13. The image-forming device according to claim 12, wherein the transmission parameter is set so that the deviation of the image is smaller than 50 μm that is a threshold at which the human retina can no longer perceive the deviation of the image when the image is held 300 mm away from the human retina.

14. The image-forming device according to claim 13, wherein the endless belt has a specific Young's modules capable of performing stretching and contracting to absorb the second fluctuation.

15. The image-forming device according to claim 13, wherein the endless belt has a cross-sectional area in a thickness direction, wherein the stretch property is based on the cross-sectional area.

16. The image-forming device according to claim 13, wherein the endless belt has a length over one loop, wherein the stretch property is based on the length.

17. The image-forming device according to claim 13, wherein the drive roller and the endless belt provides a predetermined friction in order to realize stretching and contracting of the endless belt, when the drive roller drives the endless belt.

18. The image-forming device according to claim 13, further comprising a cleaning unit that contacts a surface of the endless belt to clean the surface of the endless belt, wherein the cleaning unit applies a load to the endless belt in order to realize stretching and contracting of the endless belt, when the cleaning unit contacts the surface of the endless belt.

19. The image-forming device according to claim 13, wherein the follower roller and the endless belt provides a predetermined friction in order to realize stretching and contracting of the endless belt, when the second force is transferred from the endless belt to the follower roller.

20. The image-forming device according to claim 11, wherein the endless belt is used to transfer an image formed on the endless belt to a recording medium.

21. An image-forming device comprising:

a drive roller that rotates upon receiving a driving force from a drive motor;

a follower roller rotatable as a result of rotation of the drive roller;

an endless belt that is looped around the drive roller and follower roller, and formed of a resilient material; and a plurality of image-forming units that forms an image on the endless belt or the recording medium on the endless belt, wherein the drive roller transfers a first force based on the driving force to the endless belt to circularly move at a first velocity at a first boundary between the drive roller and the endless belt, the first velocity providing a first fluctuation, wherein the endless belt transfers a second force based on the first force to the follower roller to rotate, the endless belt moving at a second velocity at a second boundary between the follower roller and the endless belt, the second velocity providing a second fluctuation, wherein a transmission parameter with respect to at least one of the drive roller, the follower roller and the endless belt is set so that the second fluctuation is smaller than the first fluctuation, and wherein the first fluctuation periodically occurs at every predetermined period, the plurality of image-forming units being disposed at intervals equivalent to an n-multiple of the period of the first fluctuation, where n is an integer greater then 1.

22. An image-forming device comprising:

a drive roller that rotates upon receiving a driving force from a drive motor;

a follower roller rotatable as a result of rotation of the drive roller;

an endless belt that is looped around the drive roller and follower roller, and formed of a resilient material; and a plurality of image-forming units that forms an image on the endless belt or the recording medium on the endless belt, wherein the drive roller transfers a first force based on the driving force to the endless belt to circularly move at a first velocity at a first boundary between the drive roller and the endless belt, the first velocity providing a first fluctuation, wherein the endless belt transfers a second force based on the first force to the follower roller to rotate, the endless belt moving at a second velocity at a second boundary between the follower roller and the endless belt, the second velocity providing a second fluctuation, wherein a transmission parameter with respect to at least one of the drive roller, the follower roller and the endless belt is set so that the second fluctuation is smaller than the first fluctuation, and wherein the plurality of image-forming units includes a first set of image-forming units and a second image-forming unit, the first set of image-forming units superposing colors in combination with another image-forming unit at a first frequency, the second image-forming unit superposing colors in combination with another image-forming unit at a second frequency, the second frequency being smaller that the first frequency, wherein the first set of image-forming units are disposed in a position nearer the follower roller than the second image-forming unit to the follower roller.

23. The image-forming device according to claim 22, wherein the first set of image-forming units form an image in cyan, magenta, or yellow.

24. The image-forming device according to claim 22, wherein the second image-forming unit forms an image in black.

* * * * *